US011478076B2

(12) United States Patent
Gibbons, Jr. et al.

(10) Patent No.: US 11,478,076 B2
(45) **Date of Patent: *Oct. 25, 2022**

(54) CORRUGATED HUTCH

(71) Applicant: Menasha Corporation, Neenah, WI (US)

(72) Inventors: Chris Alan Gibbons, Jr., Bellflower, CA (US); Hector Gonzalez, La Mirada, CA (US)

(73) Assignee: Menasha Corporation, Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/197,594

(22) Filed: Mar. 10, 2021

(65) Prior Publication Data

US 2021/0244178 A1 Aug. 12, 2021

Related U.S. Application Data

(63) Continuation of application No. 16/797,973, filed on Feb. 21, 2020, now Pat. No. 10,973,317, which is a continuation of application No. 15/485,287, filed on Apr. 12, 2017, now Pat. No. 10,568,422.

(60) Provisional application No. 62/323,131, filed on Apr. 15, 2016.

(51) Int. Cl.

| | |
|---|---|
| ***A47B 43/02*** | (2006.01) |
| ***A47B 47/06*** | (2006.01) |
| ***A47F 5/11*** | (2006.01) |

(52) U.S. Cl.

CPC ..... *A47B 43/02* (2013.01); *A47B 47/06* (2013.01); *A47F 5/116* (2013.01); *A47F 5/11* (2013.01)

(58) Field of Classification Search

CPC ..... A47B 43/02; A47B 47/06; A47B 43/00; A47B 55/06; A47B 2200/0086; A47B 5/116; A47B 5/112

USPC ..... 229/120.34, 104, 120.11, 125.28, 149, 229/160; 211/149, 135, 132.1, 153, 186, 211/73, 195, 72; 312/259; 248/174

See application file for complete search history.

(56) References Cited

U.S. PATENT DOCUMENTS

| | | | |
|---|---|---|---|
| 1,827,008 | A | 10/1931 | Huckel |
| 1,912,847 | A | 6/1933 | Earl |
| 1,992,373 | A | 2/1935 | Johnson |
| 2,018,707 | A | 10/1935 | Daller |

(Continued)

FOREIGN PATENT DOCUMENTS

| | | | |
|---|---|---|---|
| CA | 3076091 | A1 | 9/2020 |
| DE | 102006043829 | A1 | 3/2008 |

(Continued)

OTHER PUBLICATIONS

LeBlanc, Rick, "Limits on Export Pallets Creating Corrugated Window of Opportunity; Corrugated Pallet Suppliers Experiencing Renewed Interest for Expert, Domestic Markets," http://www.palletenterprise.com/articledatabase/view.asp?articleID-648; 4 pages; Apr. 1, 2002.

(Continued)

*Primary Examiner* — Christopher R Demeree

(74) *Attorney, Agent, or Firm* — Greensfelder, Hemker & Gale, P.C.; Richard C. Himelhoch

(57) ABSTRACT

The present invention provides a hutch having a pair of opposed sidewalls and a back wall and a shelf having a first planar surface extending between the sidewalls supported by four support panels each having a second planar surface transverse to the first planar surface.

6 Claims, 11 Drawing Sheets

(56) References Cited

U.S. PATENT DOCUMENTS

| | | | |
|---|---|---|---|
| D104,437 | S | 5/1937 | Bulman |
| 2,150,743 | A | 3/1939 | Mancuso |
| 2,307,992 | A | 1/1943 | Calhoun et al. |
| 2,339,656 | A | 1/1944 | Shina |
| D146,386 | S | 2/1947 | Shield |
| D153,188 | S | 3/1949 | Stensgaard |
| D158,775 | S | 5/1950 | Malkin |
| D158,776 | S | 5/1950 | Malkin |
| 2,666,531 | A | 1/1954 | Anderson, Jr. |
| 2,706,066 | A | 4/1955 | Wells |
| 2,798,685 | A | 7/1957 | Mooney |
| 2,884,179 | A | 4/1959 | Rossum |
| 2,918,178 | A | 12/1959 | Leone |
| 2,944,555 | A | 7/1960 | Peel et al. |
| 2,975,890 | A | 3/1961 | Block |
| 2,997,222 | A | 8/1961 | Sperry |
| 3,000,602 | A | 9/1961 | O'Brien |
| 3,026,015 | A | 3/1962 | Severn |
| 3,026,078 | A | 3/1962 | Simkins |
| 3,058,646 | A | 10/1962 | Guyer |
| 3,161,341 | A | 12/1964 | Farquhar |
| D204,434 | S | 4/1966 | Kingsford |
| 3,480,196 | A | 11/1969 | De Simas |
| 3,514,031 | A | 5/1970 | Burgess |
| 3,528,559 | A | 9/1970 | Miller |
| 3,690,118 | A | 9/1972 | Rainwater |
| 3,696,990 | A | 10/1972 | Dewhurst |
| 3,730,417 | A | 5/1973 | Lawson |
| 3,857,494 | A | 12/1974 | Giardini |
| 3,879,053 | A | 4/1975 | Chvala |
| 3,886,348 | A | 5/1975 | Jonathan et al. |
| 3,889,867 | A | 6/1975 | Berg |
| 3,944,128 | A | 3/1976 | Hogan |
| D239,805 | S | 5/1976 | South |
| 4,004,691 | A | 1/1977 | Wihksne |
| D244,117 | S | 4/1977 | Naylor |
| 4,085,847 | A | 4/1978 | Jacalone |
| 4,099,813 | A | 7/1978 | Olivan |
| 4,171,741 | A | 10/1979 | Fish |
| 4,271,766 | A | 6/1981 | Schmiedeler |
| 4,283,000 | A | 8/1981 | White |
| 4,292,901 | A | 10/1981 | Cox |
| 4,311,100 | A | 1/1982 | Gardner et al. |
| 4,375,874 | A | 3/1983 | Leotta et al. |
| 4,376,558 | A | 3/1983 | Bandar |
| 4,493,424 | A | 1/1985 | Smith |
| 4,503,973 | A | 3/1985 | Andersson |
| 4,506,790 | A | 3/1985 | Muscari |
| D278,493 | S | 4/1985 | Brescia et al. |
| 4,512,541 | A | 4/1985 | Lietzke |
| 4,570,805 | A | 2/1986 | Smith |
| 4,602,735 | A | 7/1986 | Aaron |
| 4,610,355 | A | 9/1986 | Maurer |
| 4,618,115 | A | 10/1986 | Belokin, Jr. |
| 4,630,740 | A | 12/1986 | Belokin, Jr. |
| 4,646,922 | A | 3/1987 | Smith |
| 4,658,984 | A | 4/1987 | Brunner |
| 4,673,092 | A | 6/1987 | Lamson et al. |
| 4,688,716 | A | 8/1987 | Winterling |
| D292,659 | S | 11/1987 | Svezia et al. |
| D293,520 | S | 1/1988 | Ovitz, III |
| 4,722,473 | A | 2/1988 | Sandrini et al. |
| D294,908 | S | 3/1988 | Childress |
| 4,765,492 | A | 8/1988 | Howard et al. |
| 4,793,664 | A | 12/1988 | Jackson |
| 4,826,265 | A | 5/1989 | Hockenberry |
| 4,836,379 | A | 6/1989 | Shaw |
| 4,850,284 | A | 7/1989 | DeGroot et al. |
| 4,852,756 | A | 8/1989 | Holladay |
| 4,863,024 | A | 9/1989 | Booth |
| 4,871,067 | A | 10/1989 | Valenti |
| 4,877,137 | A | 10/1989 | Govang et al. |
| 4,899,929 | A | 2/1990 | Grollman |
| 4,911,084 | A | 3/1990 | Sato et al. |
| 4,911,311 | A | 3/1990 | Nagai |
| 4,936,470 | A | 6/1990 | Prindle |
| D321,100 | S | 10/1991 | Dorrell |
| D321,295 | S | 11/1991 | Nuebler |
| D321,615 | S | 11/1991 | Lavine et al. |
| 5,067,418 | A | 11/1991 | Carter |
| 5,119,740 | A | 6/1992 | Carter |
| 5,125,520 | A | 6/1992 | Kawasaki |
| 5,141,105 | A | 8/1992 | Maye |
| 5,176,265 | A | 1/1993 | Bennett |
| D332,883 | S | 2/1993 | Staude |
| 5,183,166 | A | 2/1993 | Belokin, Jr. et al. |
| 5,195,440 | A | 3/1993 | Gottlieb |
| 5,213,220 | A | 5/1993 | McBride |
| 5,259,631 | A | 11/1993 | Brande |
| 5,269,219 | A | 12/1993 | Juvik-Woods |
| 5,272,990 | A | 12/1993 | Carter |
| 5,315,936 | A | 5/1994 | Smith |
| D349,202 | S | 8/1994 | Eliadis et al. |
| 5,335,593 | A | 8/1994 | Stoddard et al. |
| D351,076 | S | 10/1994 | Eliadis et al. |
| 5,357,875 | A | 10/1994 | Winebarger et al. |
| 5,388,531 | A | 2/1995 | Crews et al. |
| 5,413,053 | A | 5/1995 | Vannatta |
| 5,427,019 | A | 6/1995 | Moorman |
| 5,443,168 | A | 8/1995 | Dyment et al. |
| D362,768 | S | 10/1995 | Lechleiter et al. |
| 5,458,411 | A | 10/1995 | Moss |
| D363,840 | S | 11/1995 | Weshler |
| 5,465,672 | A | 11/1995 | Boyse et al. |
| 5,465,851 | A | 11/1995 | Smith |
| 5,487,344 | A | 1/1996 | Hutchinson |
| 5,487,345 | A | 1/1996 | Winebarger |
| D369,035 | S | 4/1996 | Potter |
| D369,043 | S | 4/1996 | Parker |
| 5,520,120 | A | 5/1996 | Badger |
| 5,528,994 | A | 6/1996 | Iseli |
| 5,540,536 | A | 7/1996 | Hoedl |
| 5,543,205 | A | 8/1996 | Liebel |
| 5,590,606 | A | 1/1997 | Crews et al. |
| 5,603,258 | A | 2/1997 | Besaw |
| 5,622,306 | A | 4/1997 | Grigsby et al. |
| 5,630,518 | A | 5/1997 | Collins |
| 5,669,683 | A | 9/1997 | Moss et al. |
| 5,672,412 | A | 9/1997 | Phares et al. |
| 5,678,492 | A | 10/1997 | Pinkstone et al. |
| 5,685,234 | A | 11/1997 | Grigsby et al. |
| D388,905 | S | 1/1998 | Wells |
| 5,706,953 | A | 1/1998 | Polvere |
| 5,706,959 | A | 1/1998 | Smith |
| 5,711,423 | A | 1/1998 | Fuller, Jr. |
| 5,715,623 | A | 2/1998 | Mackey, III |
| D395,534 | S | 6/1998 | Besaw |
| 5,758,783 | A | 6/1998 | Maglione |
| 5,762,213 | A | 6/1998 | Heneveld, Sr. |
| 5,791,487 | A | 8/1998 | Dixon |
| 5,794,542 | A | 8/1998 | Besaw |
| 5,797,499 | A | 8/1998 | Pinco |
| D398,461 | S | 9/1998 | Baluk et al. |
| D398,462 | S | 9/1998 | Baluk et al. |
| 5,809,903 | A | 9/1998 | Young, Jr. |
| 5,816,172 | A | 10/1998 | Carter |
| 5,826,732 | A | 10/1998 | Ragsdale |
| 5,832,841 | A | 11/1998 | Crews et al. |
| 5,881,652 | A | 3/1999 | Besaw |
| D412,253 | S | 7/1999 | Brozak, Jr. |
| 5,918,744 | A | 7/1999 | Bringard et al. |
| 5,950,914 | A | 9/1999 | Dunton et al. |
| 5,980,008 | A | 11/1999 | Stoever |
| 5,996,366 | A | 12/1999 | Renard |
| 5,996,510 | A | 12/1999 | Harpman et al. |
| D419,275 | S | 1/2000 | Carter |
| D419,744 | S | 1/2000 | Carter |
| 6,012,399 | A | 1/2000 | Carter |
| 6,070,726 | A | 6/2000 | Graham |
| 6,076,475 | A | 6/2000 | Kuhn et al. |
| D428,738 | S | 8/2000 | Brozak, Jr. |
| 6,098,820 | A | 8/2000 | Smith |
| 6,126,131 | A | 10/2000 | Tietz |
| 6,126,254 | A | 10/2000 | Maglione |

(56) References Cited

U.S. PATENT DOCUMENTS

| | | | |
|---|---|---|---|
| 6,135,030 | A | 10/2000 | Besaw |
| D433,782 | S | 11/2000 | Carter |
| D433,839 | S | 11/2000 | Culbertson |
| 6,145,671 | A | 11/2000 | Riga et al. |
| 6,145,794 | A | 11/2000 | Smith |
| 6,164,215 | A | 12/2000 | Cook et al. |
| 6,189,778 | B1 | 2/2001 | Kanter |
| 6,302,283 | B1 | 10/2001 | Yeh |
| D453,057 | S | 1/2002 | Sewell |
| 6,354,229 | B1 | 3/2002 | Heidtke |
| 6,357,587 | B1 | 3/2002 | Melms, Jr. |
| 6,360,465 | B1 | 3/2002 | Simpson |
| 6,394,003 | B1 | 5/2002 | Lacy, III |
| 6,394,290 | B1 | 5/2002 | Walsh et al. |
| D461,334 | S | 8/2002 | Johnson et al. |
| D464,498 | S | 10/2002 | Riga et al. |
| 6,510,982 | B2 | 1/2003 | White et al. |
| 6,585,118 | B2 | 7/2003 | Kellogg |
| 6,612,247 | B1 | 9/2003 | Pistner et al. |
| 6,612,669 | B2 | 9/2003 | Grueneberg |
| 6,659,295 | B1 | 12/2003 | De Land et al. |
| 6,715,623 | B2 | 4/2004 | Broerman |
| 6,729,484 | B2 | 5/2004 | Sparkowski |
| 6,752,280 | B2 | 6/2004 | Dye |
| 6,758,352 | B2 | 7/2004 | Gervasi |
| 6,769,368 | B2 | 8/2004 | Underbrink et al. |
| D495,901 | S | 9/2004 | Bosman |
| 6,814,245 | B2 | 11/2004 | Leclerc et al. |
| 6,902,074 | B2 | 6/2005 | Albrecht |
| 6,905,021 | B2 | 6/2005 | Polumbaum et al. |
| D509,382 | S | 9/2005 | Raile |
| 6,951,300 | B2 | 10/2005 | Caille et al. |
| 6,966,447 | B2 | 11/2005 | Hiltke et al. |
| 7,007,615 | B2 | 3/2006 | Grueneberg |
| D521,275 | S | 5/2006 | Dusenberry |
| 7,036,196 | B2 | 5/2006 | Salatin et al. |
| 7,066,342 | B2 | 6/2006 | Baechle et al. |
| 7,066,380 | B2 | 6/2006 | Blake |
| 7,089,872 | B2 | 8/2006 | Wintermute, II et al. |
| 7,111,735 | B2 | 9/2006 | Lowry |
| 7,137,517 | B2 | 11/2006 | Lowry et al. |
| D533,734 | S | 12/2006 | Campbell |
| 7,191,906 | B1 | 3/2007 | Pinco |
| 7,234,604 | B2 | 6/2007 | Eisele |
| 7,252,200 | B1 | 8/2007 | Hester |
| D566,989 | S | 4/2008 | Mason |
| D576,426 | S | 9/2008 | Yuen-Schat et al. |
| D578,804 | S | 10/2008 | Norman et al. |
| 7,546,926 | B2 | 6/2009 | Stolle et al. |
| 7,546,927 | B2 | 6/2009 | Lowry et al. |
| 7,571,820 | B2 | 8/2009 | Alexander |
| D603,189 | S | 11/2009 | Raile |
| 7,650,996 | B2 | 1/2010 | Mark |
| 7,677,433 | B2 | 3/2010 | Little |
| 7,703,665 | B2 | 4/2010 | McGowan |
| 7,703,864 | B2 | 4/2010 | Moser |
| 7,717,265 | B2 | 5/2010 | Honkawa et al. |
| 7,726,474 | B2 | 6/2010 | Berger et al. |
| 7,828,169 | B2 | 11/2010 | Robinson et al. |
| 7,882,966 | B2 | 2/2011 | Field et al. |
| 7,905,365 | B2 | 3/2011 | Virvo |
| 7,992,716 | B2 | 8/2011 | Jackson |
| 8,002,171 | B2 | 8/2011 | Ryan et al. |
| 8,141,713 | B2 | 3/2012 | Farkas et al. |
| 8,157,112 | B2 | 4/2012 | Bojie |
| 8,317,039 | B2 | 11/2012 | Norman |
| 8,485,370 | B2 | 7/2013 | Dewhurst |
| 8,857,633 | B2 | 10/2014 | Dewhurst |
| 8,985,328 | B2 | 3/2015 | Slaats |
| 9,045,250 | B2 | 6/2015 | Henderson et al. |
| 9,198,508 | B1 | 12/2015 | Kufel |
| 9,211,021 | B2 | 12/2015 | Smith |
| 9,428,298 | B2 | 8/2016 | Bersamin et al. |
| 9,474,389 | B2 | 10/2016 | Pfeifer et al. |
| 9,487,321 | B2 | 11/2016 | Luke |
| 9,743,783 | B1 | 8/2017 | Bersamin |
| 9,844,282 | B2 | 12/2017 | Smith |
| 9,907,414 | B2 | 3/2018 | Heuer |
| 9,919,829 | B2 | 3/2018 | Jolley |
| 9,938,040 | B2 | 4/2018 | Buscema |
| 9,969,523 | B2 | 5/2018 | Ayerst |
| 9,918,569 | B1 | 8/2018 | Abel |
| 10,117,529 | B2 | 11/2018 | Abel |
| 10,123,635 | B2 | 11/2018 | Lilja |
| 10,159,362 | B2 | 12/2018 | Smith |
| 10,306,999 | B2 | 6/2019 | Smith |
| 10,315,798 | B2 | 6/2019 | Pfeifer et al. |
| 10,448,758 | B1 | 10/2019 | Abel |
| 10,463,176 | B1 | 11/2019 | Sells |
| 10,470,591 | B1 | 11/2019 | Heiden et al. |
| 10,524,589 | B2 | 1/2020 | Donegan |
| 10,531,750 | B1 | 1/2020 | Heiden et al. |
| 10,568,422 | B2 | 2/2020 | Gibbons, Jr. et al. |
| 10,568,439 | B2 | 2/2020 | Bersamin |
| 2002/0189507 | A1 | 12/2002 | Benner |
| 2003/0042828 | A1 | 3/2003 | Bonin |
| 2003/0042829 | A1 | 3/2003 | Bonin |
| 2003/0111383 | A1 | 6/2003 | Qiu et al. |
| 2004/0195195 | A1 | 10/2004 | Mason |
| 2005/0252872 | A1 | 11/2005 | Eisele |
| 2005/0274684 | A1 | 12/2005 | Swanson |
| 2006/0006096 | A1 | 1/2006 | Funk |
| 2006/0283775 | A1 | 12/2006 | Mark |
| 2007/0193479 | A1 | 8/2007 | Slaats |
| 2007/0272639 | A1 | 11/2007 | Alexander |
| 2008/0169339 | A1 | 7/2008 | Moser |
| 2008/0169340 | A1 | 7/2008 | Sheffer |
| 2008/0173602 | A1 | 7/2008 | Field et al. |
| 2008/0265726 | A1 | 10/2008 | Sheffer |
| 2009/0107940 | A1 | 4/2009 | Norman et al. |
| 2009/0127150 | A1 | 5/2009 | Meers |
| 2010/0006529 | A1 | 1/2010 | Groff et al. |
| 2010/0025344 | A1 | 2/2010 | Virvo |
| 2010/0133215 | A1 | 6/2010 | Norman |
| 2011/0000955 | A1 | 1/2011 | Manteufel et al. |
| 2011/0049072 | A1 | 3/2011 | Dewhurst |
| 2011/0266177 | A1 | 11/2011 | Lowry et al. |
| 2012/0074037 | A1 | 3/2012 | Orischak et al. |
| 2012/0305512 | A1 | 12/2012 | L'Hotel |
| 2013/0097903 | A1 | 4/2013 | Gerstner |
| 2013/0213915 | A1 | 8/2013 | Pfeifer et al. |
| 2013/0277324 | A1 | 10/2013 | Dewhurst |
| 2014/0217047 | A1 | 8/2014 | Frost |
| 2015/0041420 | A1 | 2/2015 | Zelek et al. |
| 2015/0136720 | A1 | 5/2015 | Miller |
| 2016/0066711 | A1 | 3/2016 | Mestres Armengol et al. |
| 2017/0079449 | A1 | 3/2017 | Smith |
| 2017/0295927 | A1 | 10/2017 | Gibbons, Jr. et al. |
| 2018/0042405 | A1 | 2/2018 | Lilja |
| 2018/0070747 | A1 | 3/2018 | Smith |
| 2018/0092461 | A1 | 4/2018 | Brady et al. |
| 2018/0130382 | A1 | 5/2018 | Hinch et al. |
| 2018/0146803 | A1 | 5/2018 | Urban |
| 2018/0160825 | A1 | 6/2018 | Abel |
| 2018/0289178 | A1 | 10/2018 | McMillan-Sweat et al. |
| 2019/0008290 | A1 | 1/2019 | Ertl |
| 2019/0069694 | A1 | 3/2019 | Smith |
| 2019/0150611 | A1 | 5/2019 | Burnett |
| 2019/0380513 | A1 | 12/2019 | Frost |
| 2020/0037787 | A1 | 2/2020 | Pratsch |
| 2020/0113355 | A1 | 4/2020 | Hara et al. |
| 2020/0297132 | A1 | 9/2020 | Nguyen et al. |
| 2020/0375375 | A1 | 12/2020 | Robinson |

FOREIGN PATENT DOCUMENTS

| | | | |
|---|---|---|---|
| DE | 102011116238 | A1 | 4/2013 |
| EP | 0629557 | A1 | 12/1994 |
| FR | 2984705 | A3 | 6/2013 |
| JP | 6278746 | A | 10/1994 |
| WO | 2008127499 | A1 | 10/2008 |

(56) References Cited

OTHER PUBLICATIONS

"Solid Wood Packing Materials to Argentina;" http://www.corrugatedprices.com/pallets/swang.html; 2 pages; Feb. 6, 2002.

CORRUGATED HUTCH

CROSS-REFERENCE TO RELATED APPLICATIONS

The present invention is a continuation of U.S. patent application Ser. No. 16/797,973 filed Feb. 21, 2020, which is a continuation of U.S. patent application Ser. No. 15/485,287 filed Apr. 12, 2017, now U.S. Pat. No. 10,568,422, which claims priority to and the benefit of U.S. Provisional Application No. 62/323,131 filed Apr. 15, 2016, the contents of which are incorporated herein by reference and made a part thereof.

FEDERALLY SPONSORED RESEARCH OR DEVELOPMENT

N/A

FIELD OF THE INVENTION

Point of sale shelving erected from a corrugated paperboard blank or blanks for supporting and displaying heavy items is disclosed herein.

BACKGROUND OF THE INVENTION

A variety of display units are available for displaying products or other items. However, most display units are expensive to ship and construct. Some paperboard displays are known. However, such displays are only designed to support chips and other light products. The present invention provides a hutch with a plurality of shelves that overcomes the problems of prior units.

SUMMARY OF THE INVENTION

The present invention provides a corrugated paperboard hutch configured to display heavy products. The hutch includes shelves having one or more support structures.

The present invention also provides a hutch having a pair of opposed sidewalls and a back wall and a shelf having a first planar surface extending between the sidewalls supported by four support panels each having a second planar surface transverse to the first planar surface.

The present invention also provides a hutch of a corrugated paperboard material having a pair of opposed sidewalls and a back wall extending between the opposed sidewalls and connected to a portion of each. The hutch has a first support panel extending between the pair opposed sidewalls and having opposed ends, one of each attached to one of each of the opposed sidewalls. The first support panel has a top edge and a bottom edge, a first flap extending transversely from the top edge toward the back wall and a second flap extending transversely from the bottom edge toward the back wall and parallel to the first flap and defining a gap therebetween. The hutch also has a second support panel extending between the opposed sidewalls and in the gap.

In accordance with one aspect of the invention, a hutch of a corrugated paperboard material having a pair of opposed sidewalls and a back wall extending between the opposed sidewalls and connected to a portion of each is provided. The hutch further has a first support panel extending between the pair opposed sidewalls and having opposed ends, one of each attached to one of each of the opposed sidewalls. A first flap extends transversely from the first support panel toward the back wall, and a rectangular prism extends between the opposed sidewalls and has a first planar surface in surface contact with a bottom surface of the first flap to define a shelf.

In accordance with yet another aspect of the invention, a hutch of a corrugated paperboard material having a pair of opposed sidewalls spaced from one another and each having a front edge and a rear edge is provided. A back wall extends between and connects a portion of the rear edge of each of the pair of opposed sidewalls and has a portion removed to form a slot. The hutch also has a shelf extending between the opposed sidewalls with a first panel connecting a portion of the front edges of the pair of opposed sidewalls and having: (1) a vertical surface having a top edge and a bottom edge; (2) a segmented second panel having a first portion extending vertically downwardly from the top portion and a second portion extending horizontally from the first portion toward the back wall, and a tab connected to the second portion along a hinge; and (3) a segmented third panel having a first leg extending horizontally and a second leg extending from a distal end of the first leg and a portion of the second leg extending through the slot and having a vertically disposed surface in contact with an outer planar surface of the back wall, and a slot on the first leg retaining the tab.

Further aspects of the invention are described herein and shown in the Figures.

BRIEF DESCRIPTION OF THE DRAWINGS

To understand the present invention, it will now be described by way of example, with reference to the accompanying drawings in which.

DETAILED DESCRIPTION

Figure 1:
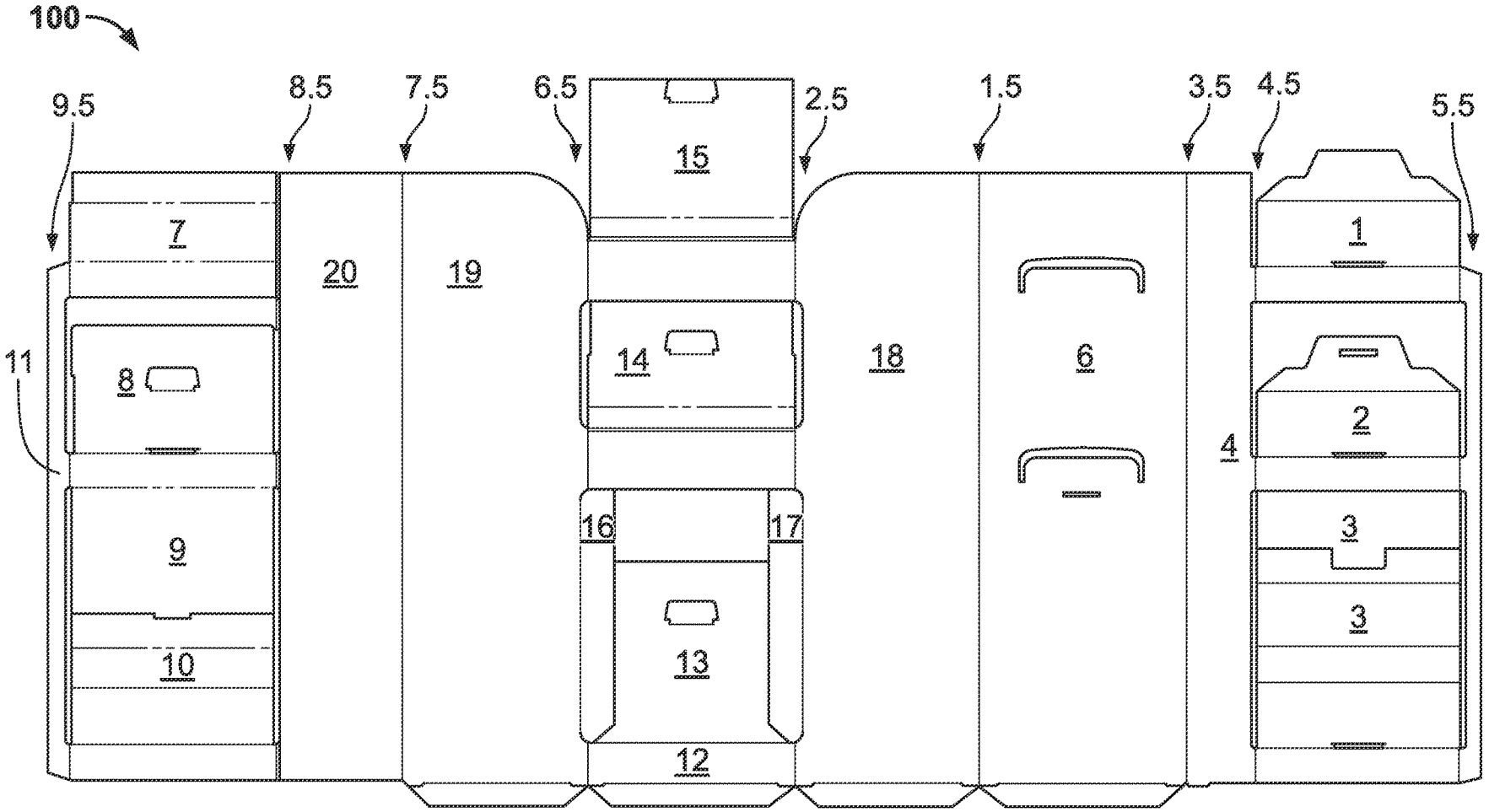
FIG. 1 shows a plan view of a blank of paperboard material for forming a hutch and indicating the vertical fold lines.

While this invention is susceptible of embodiments in many different forms, there is shown in the drawings and attachments, and will be described herein in detail, specific embodiments thereof with the understanding that the present disclosure is to be considered as an exemplification of the principles of the invention and is not intended to limit the invention to the specific embodiments illustrated.

Figure 7:
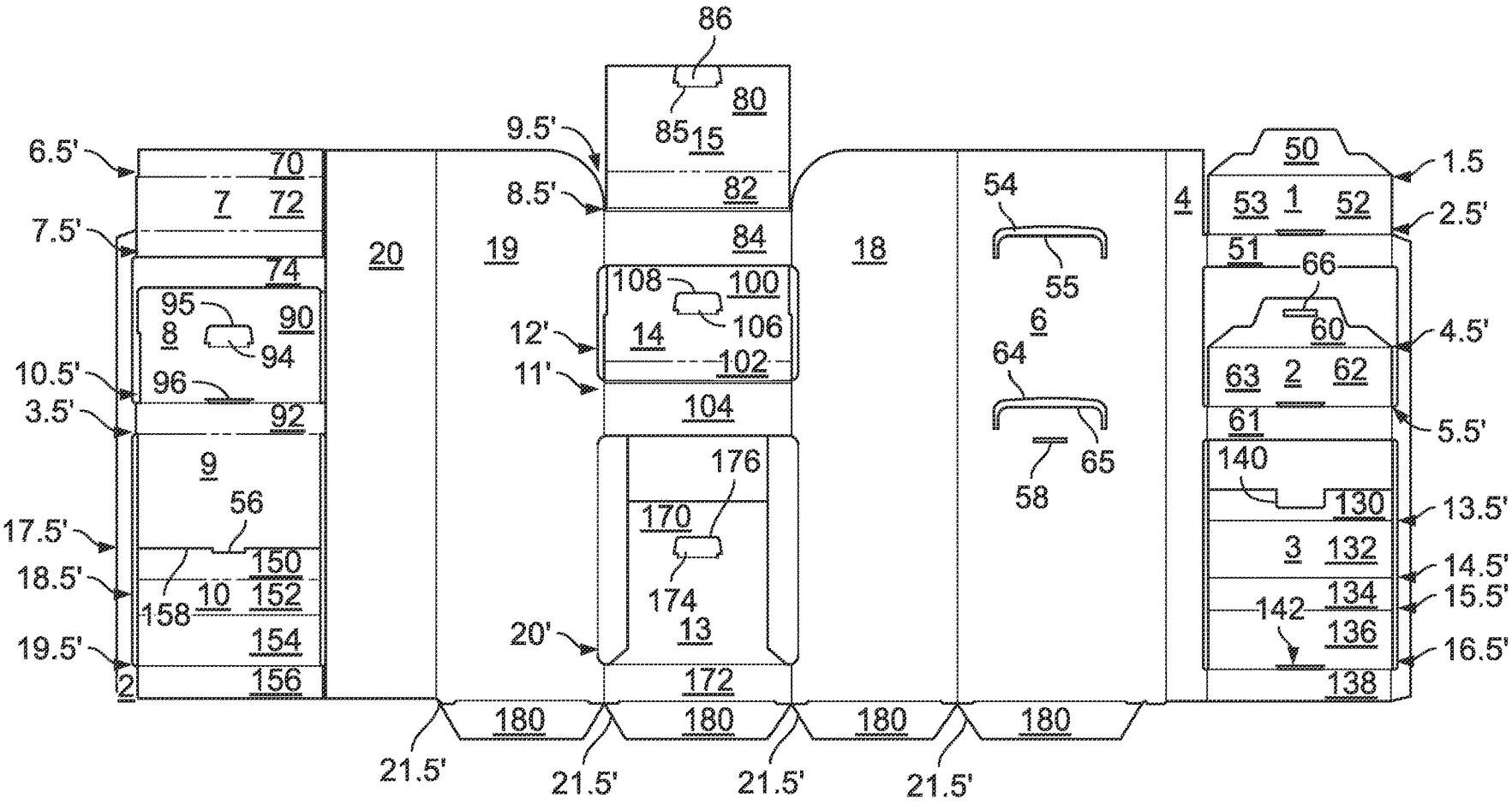
FIG. 7 shows a plan view of a blank of paperboard material for forming a hutch and indicating the horizontal fold lines.
Figure 8:
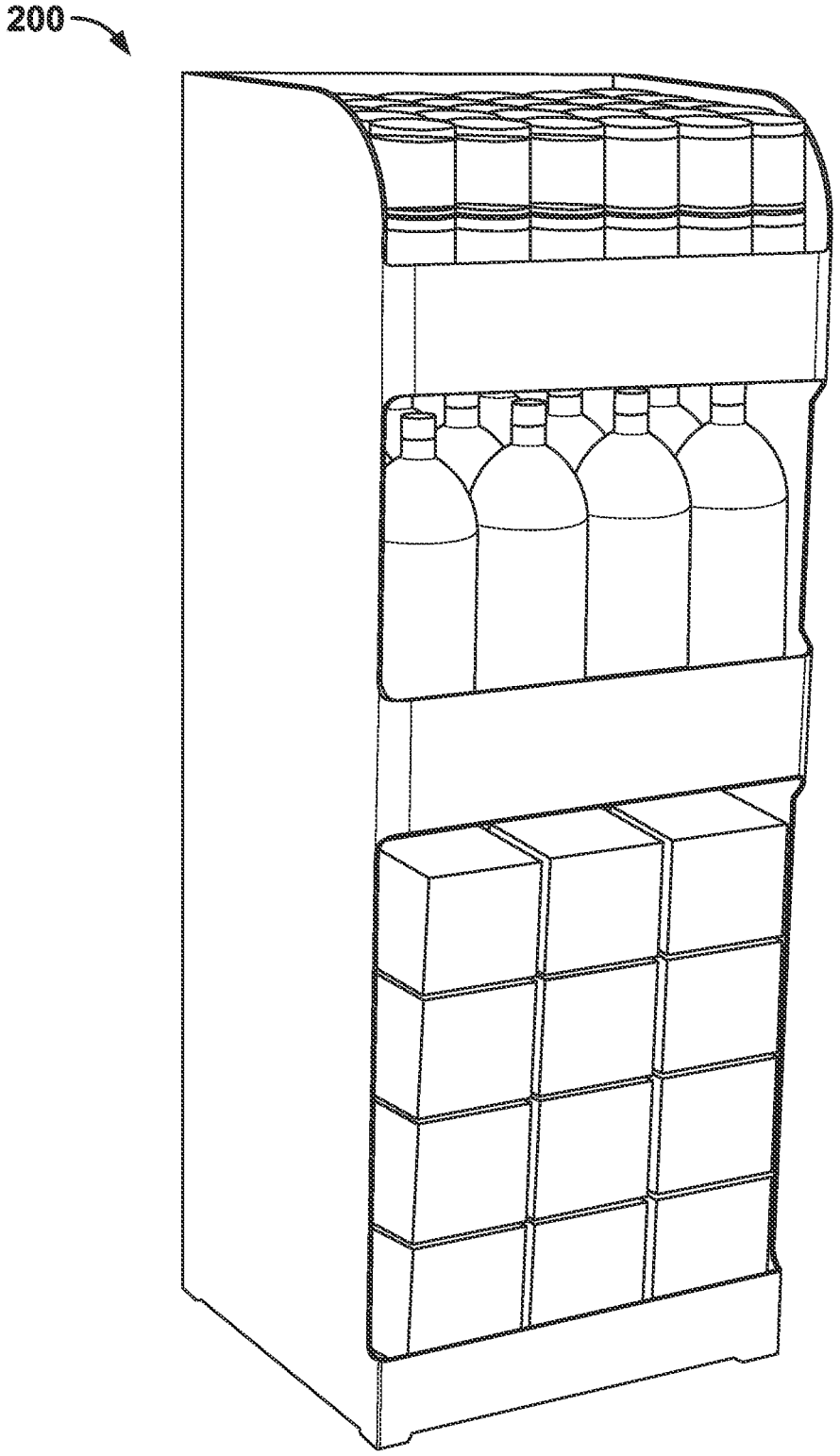
FIG. 8 is a photograph of a hutch displaying products on three shelves.
Figure 14:
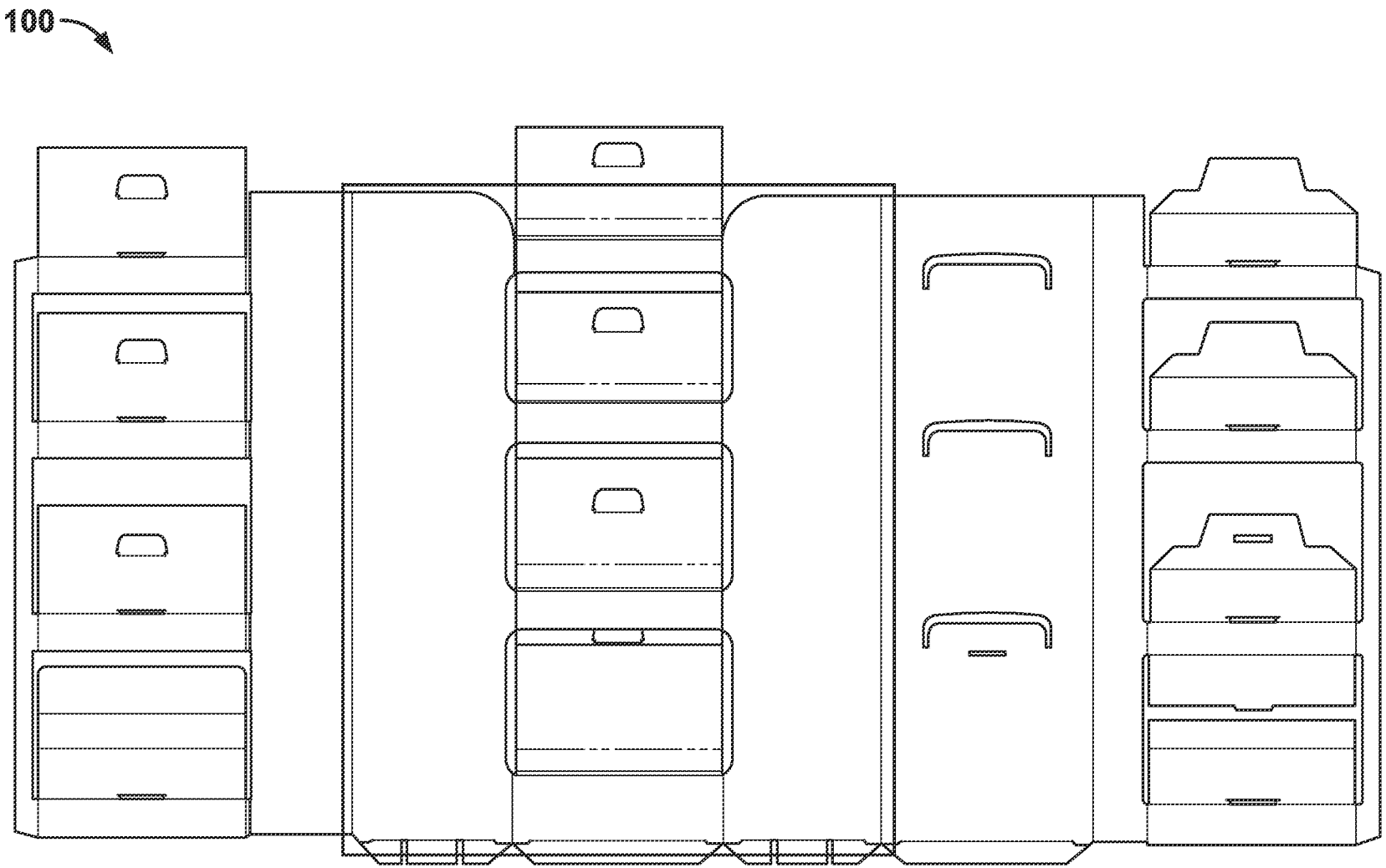
FIG. 14 shows a plan view of a blank of paperboard material for forming a hutch having four shelves.
Figure 15:
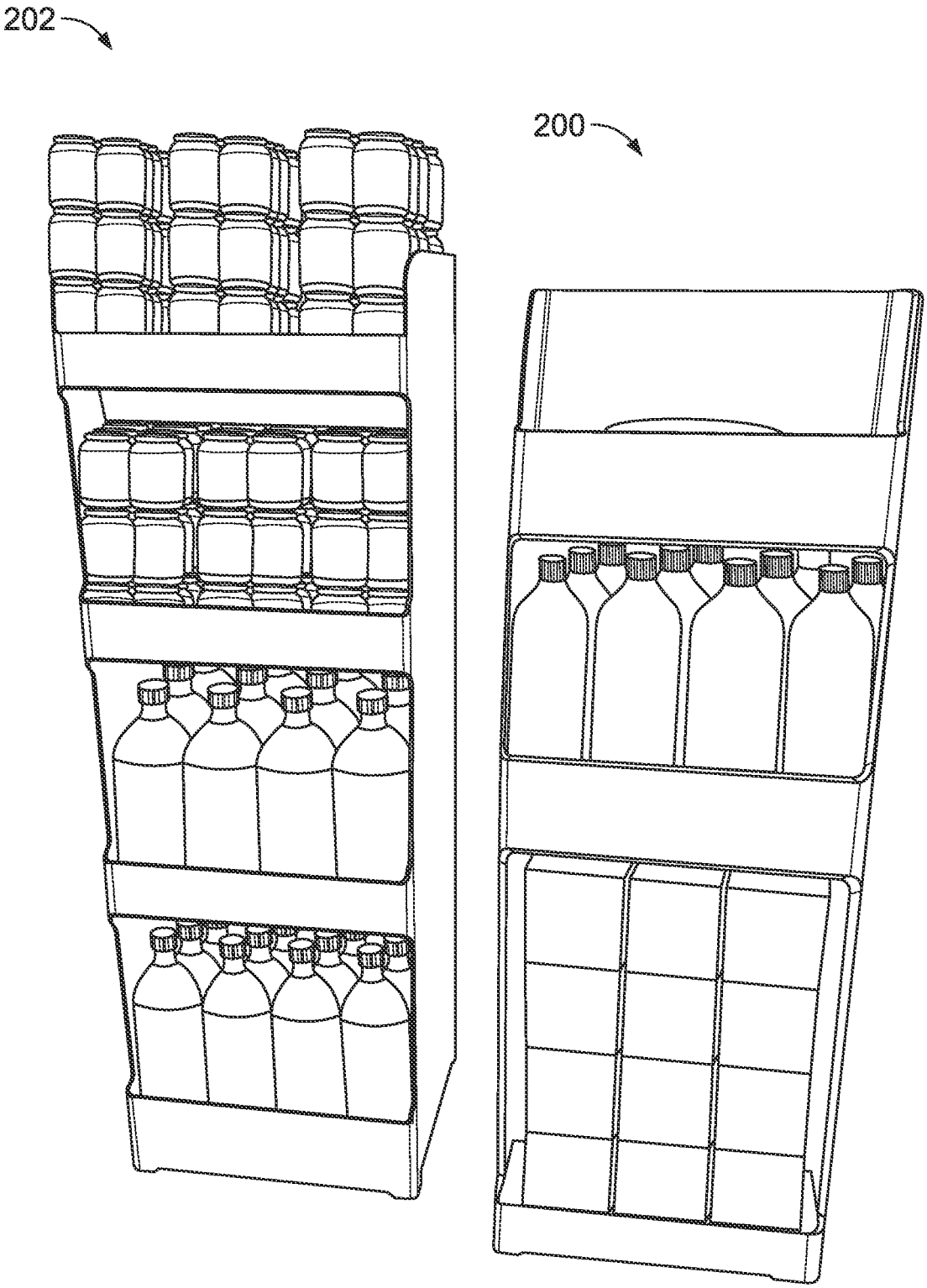
FIG. 15 is a photograph of two hutches, one having four shelves displaying soft drink products and another having three shelves.

FIGS. 1 and 7 show a paperboard blank 100 having a plurality of panels divided along vertical fold lines (FIG. 1) and horizontal fold lines (FIG. 7). When properly folded the blank forms a hutch 200 (FIG. 8) having three shelves for supporting relatively heavy items. FIG. 14 shows a blank when properly folded forms a hutch 202 having four shelves. FIG. 8 shows a hutch 200 having three shelves and FIG. 15 shows a hutch 202 having four shelves and a hutch 200 having three shelves. Notwithstanding the number of shelves, the hutch will be referred to hereafter as hutch 200. The hutch 200 is suitable as a point of sales display for items like bottles of soft drinks and cases of cans of liquids as is shown in FIG. 8. In a preferred form of the invention, a single blank 100, even more preferably a single blank 100 having a continuous planar surface, will be used to form the hutch 200. It is contemplated, however, that two or more blanks could be used to form the hutch without departing from the present invention.

In one preferred form of the invention, the blank 100 is first folded along the vertical fold lines shown in FIG. 1 to form the structures shown in FIGS. 2-6, and then the blank 100 is folded along the horizontal fold lines shown in FIGS. 7, 10-12. While the folding is described in a certain order it should be understood that what is described is an exemplary method and the folding could proceed in a different order to form the hutch 200 shown in FIGS. 8 and 15. Additionally, directional or positional words, such as top, upper, vertical, left/right, etc., are used with respect to the blank 100 and hutch 200 as shown in the various figures and are not meant to limit the invention.

Figure 2:
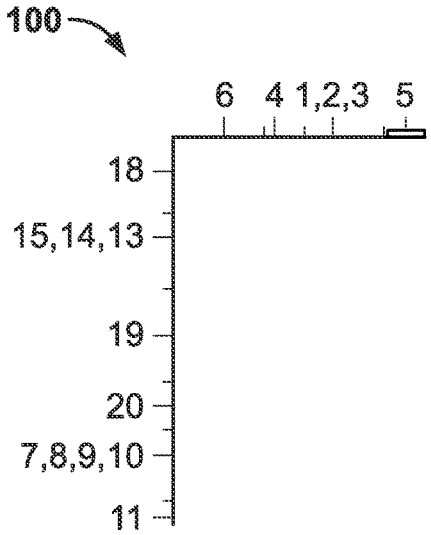
FIGS. 2-6 show a top plan view of the paperboard blank when folding along vertical fold lines.
Figure 3:
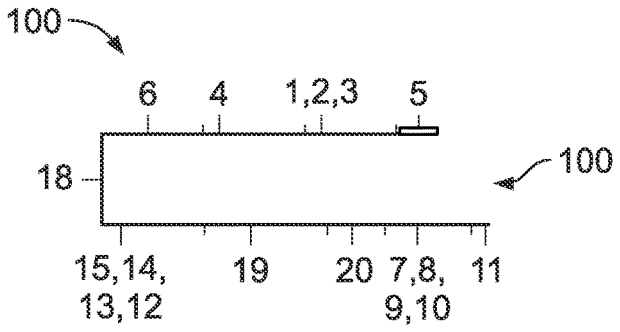
Figure 4:
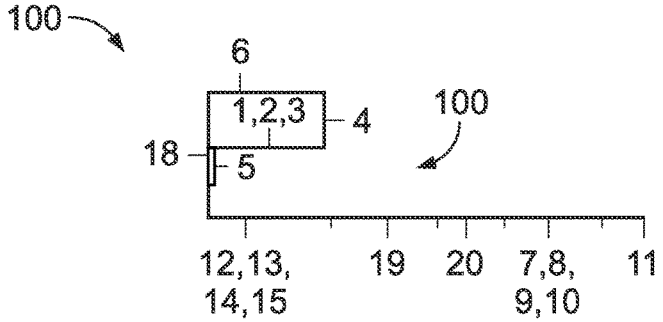

Starting with the folding along vertical fold lines, a panel 18 and those panels to the left are folded along line 1.5, 90° to form a generally L-shaped blank shown in FIG. 2. The L-shaped blank is then folded along line 2.5, 90° to the right placing panels 12, 13 and 14 in registration with panel 6 to form a generally U-shaped blank defining a chamber 100 therebetween (FIG. 3). Then, panel 4 and the panels to its right are folded 90° along line 3.5; panels 1, 2, 3 are folded 90° along line 4.5; panel 5 is reverse folded 90° along line 5.5, and panel 5 is attached to an inner surface of panel 18. In one preferred form of the invention, panel 5 is attached to panel 18 with glue, for example.

Figure 5:
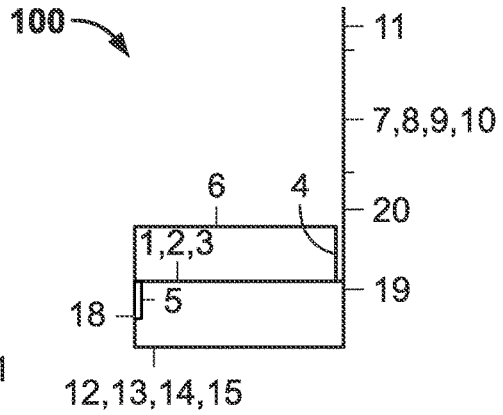
Figure 6:
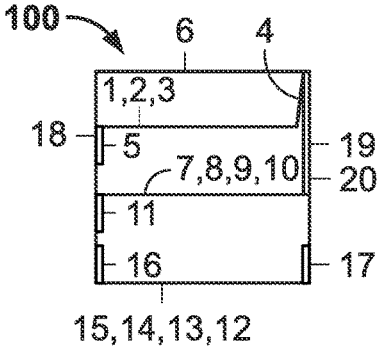

Panel 19 and the panels to its left are folded 90° along line 6.5 toward panel 6 as shown in FIG. 5. Panel 20 and those to the left are folded 180° along line 7.5 placing panel 20 into face-to-face contact with an outer surface of panel 4 and panels 7-10 are folded 90° along line 8.5 to extend parallel to panels 1, 2, 3. Panel 20 is attached to an outer surface of panel 4 with glue, for example. Panel 11 is reverse folded 90° along line 9.5 and attached to an inner surface of panel 18 as shown in FIG. 6. Panels 16 and 17 are respectively folded 180°, in opposite directions, along lines 10.5 and 11.5 into face-to-face contact with an inner surface of panels 19 and 18 and attached thereto with glue, for example.

Figure 10:
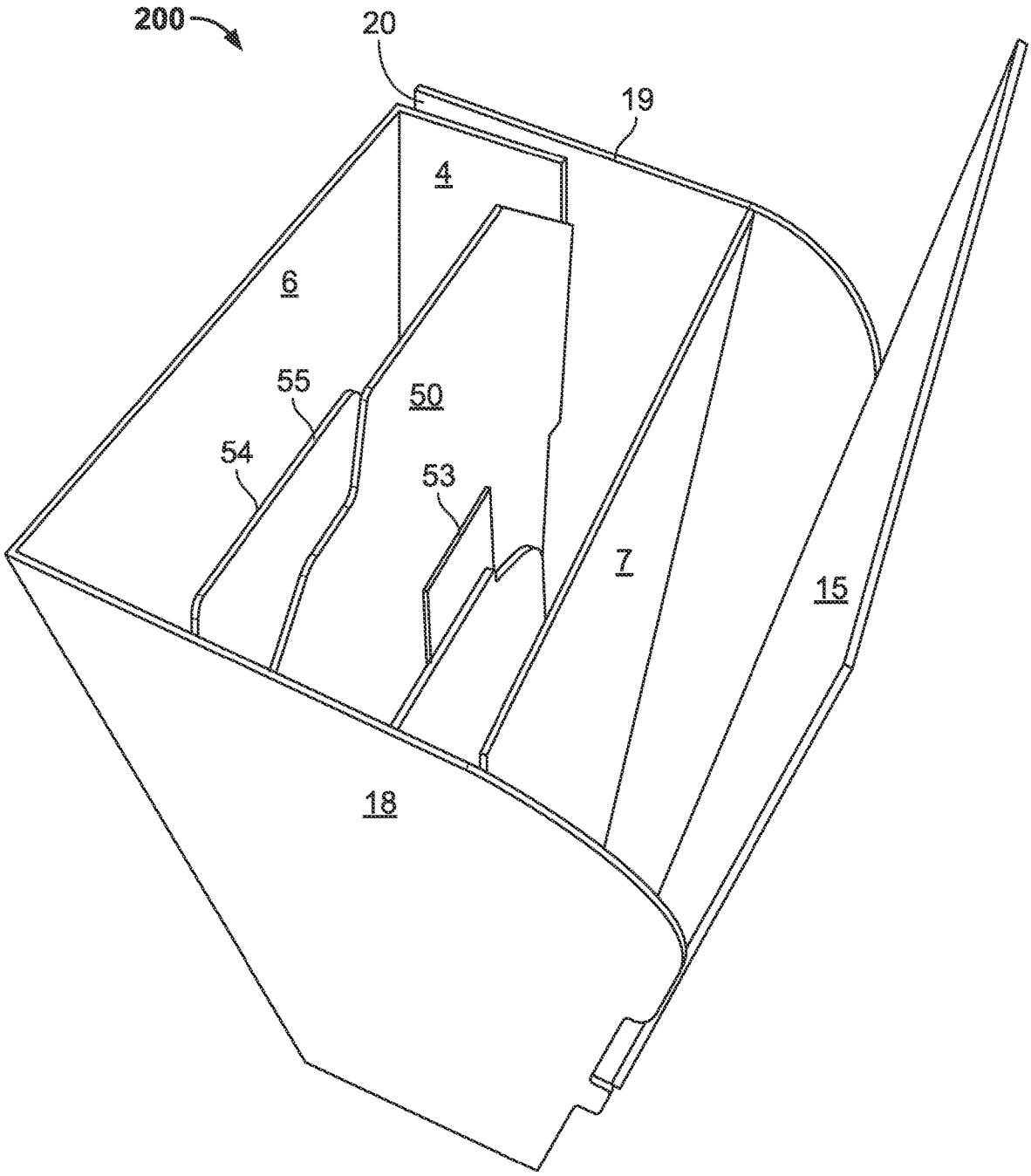
FIG. 10 is a photograph of a top or first shelf before folding along horizontal fold lines.
Figure 11:
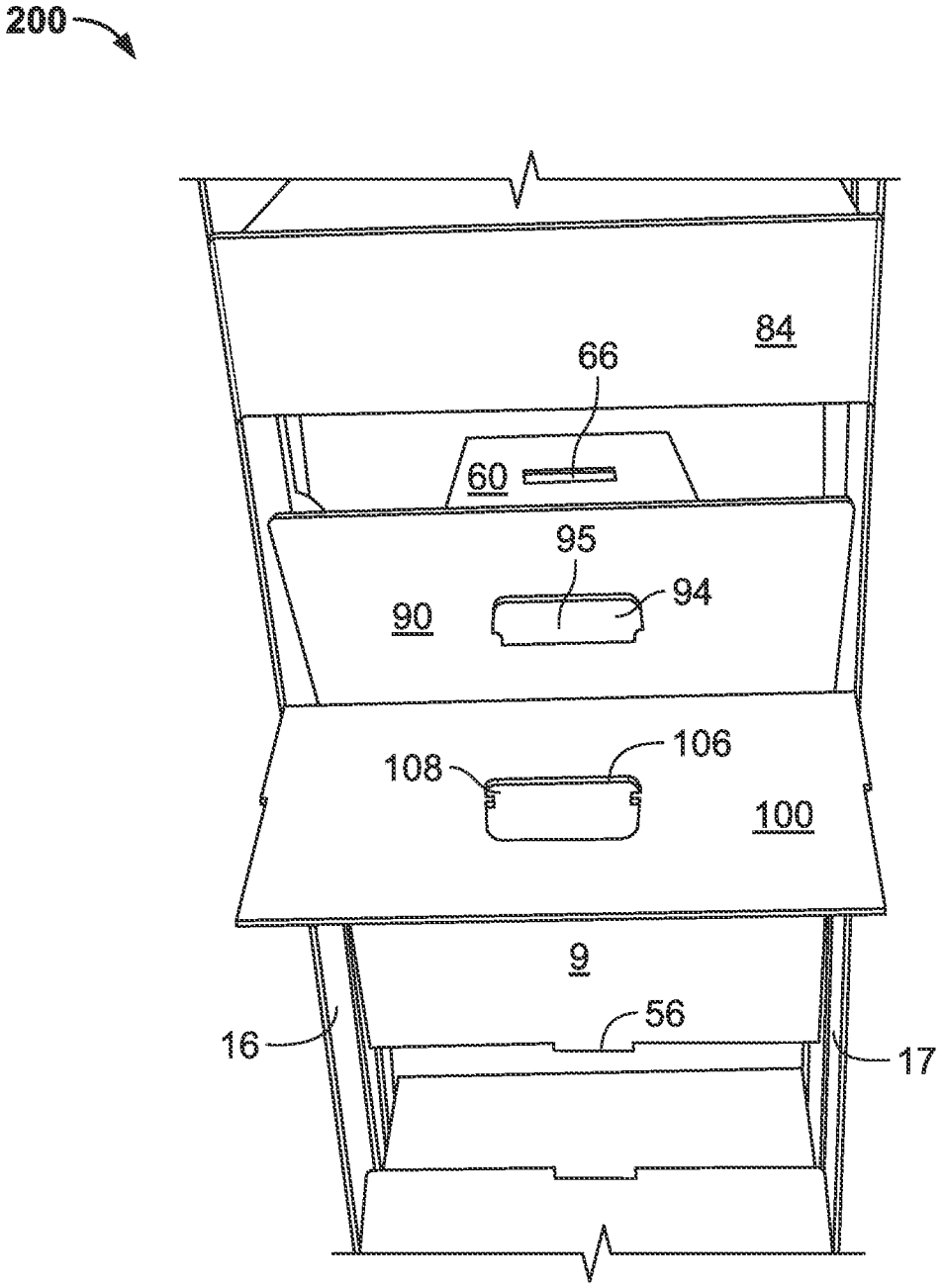
FIG. 11 is a photograph of a front view of a second shelf before folding along horizontal fold lines.
Figure 12:
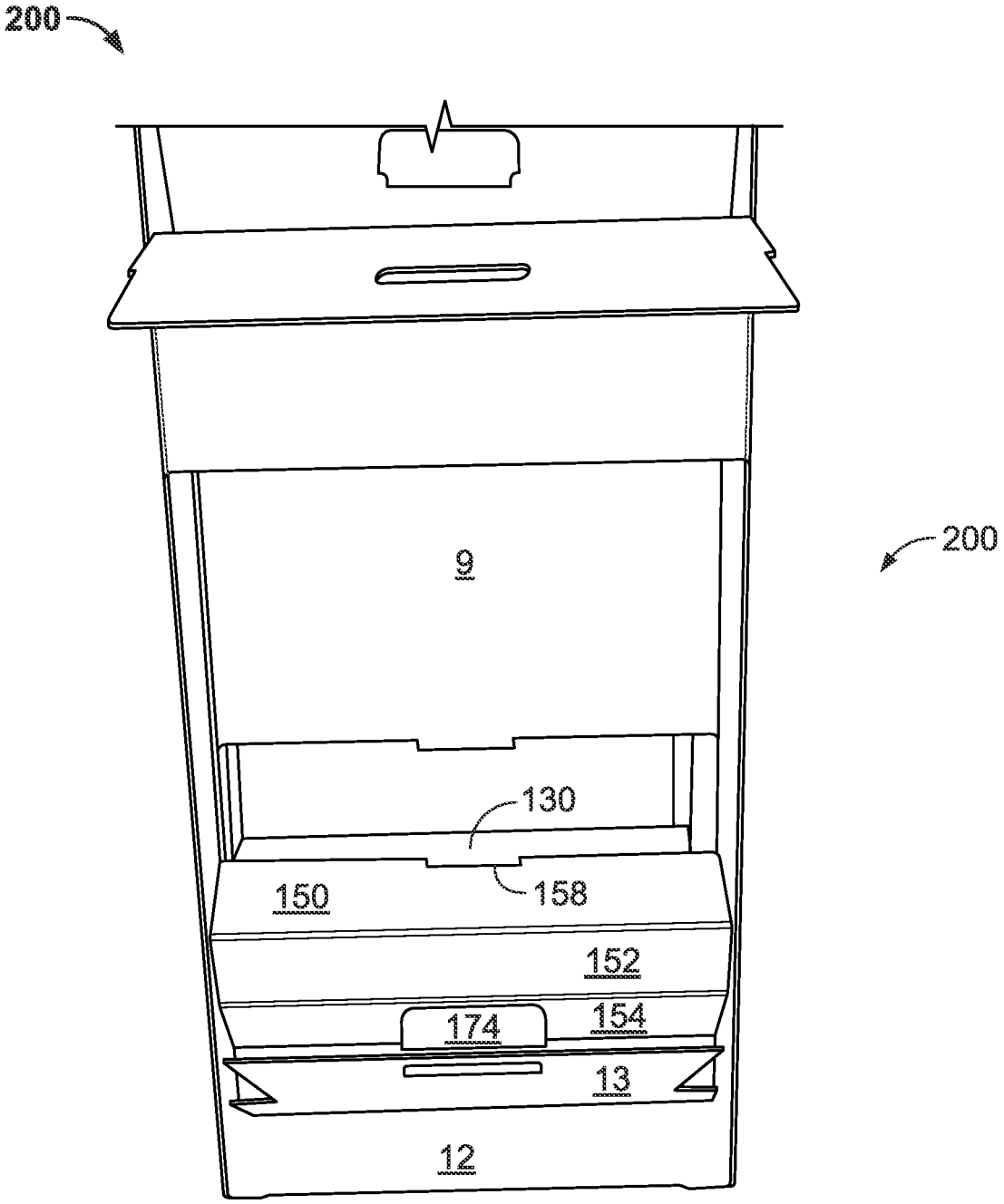
FIG. 12 is a photograph of a front view of a third shelf before folding along horizontal fold lines.

FIG. 7 shows horizontal fold lines designated with a prime (′). The panels are folded along the horizontal fold lines to complete three shelves vertically spaced from one another (FIGS. 10-12). While three shelves are shown in FIG. 8 and four shelves are shown in FIG. 15 it is contemplated having as few as two shelves and as many as needed and fits within the dimensional limitations of use. In one preferred form of the invention the hutch will have from two to six shelves.

Figure 9:
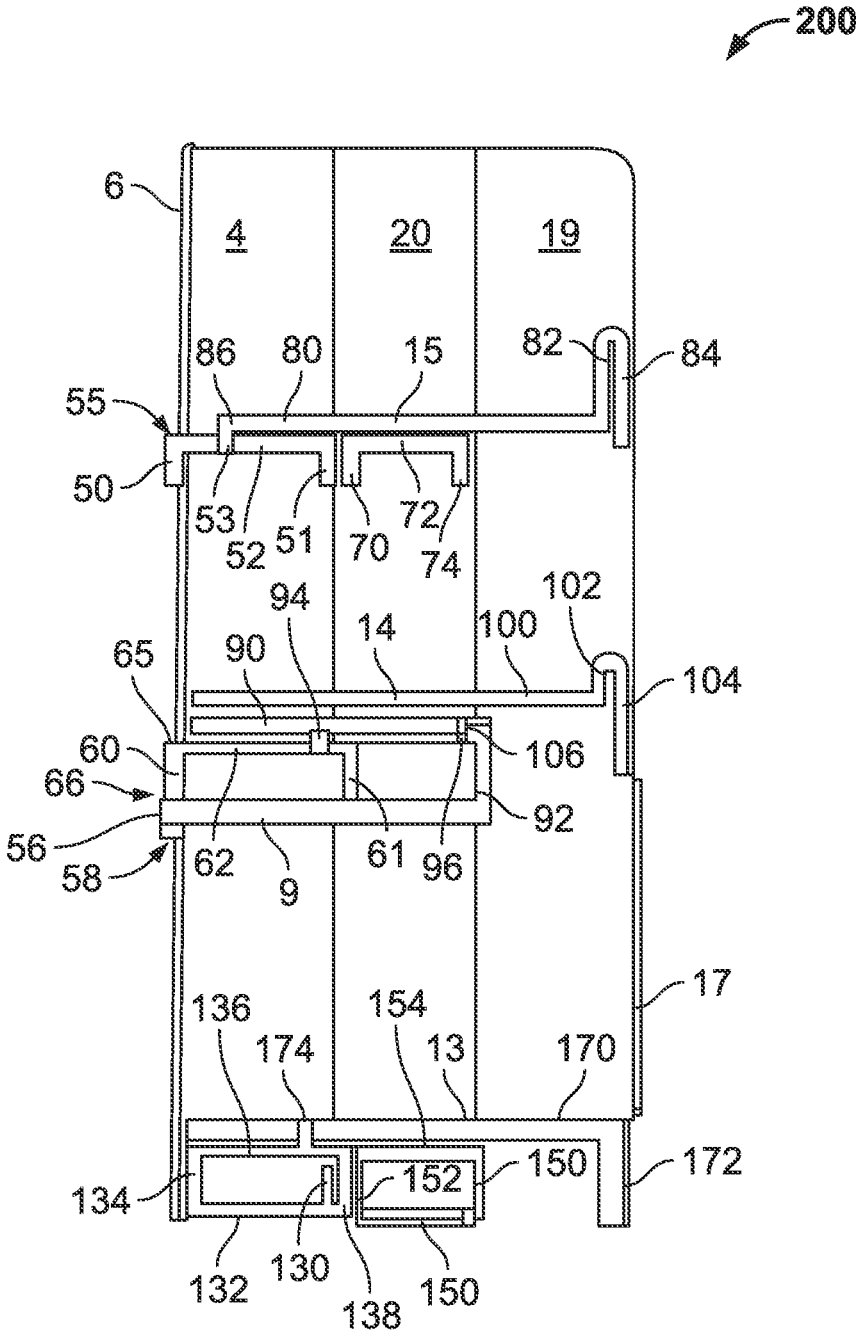
FIG. 9 is a side elevation view taken along a line through a center of the shelves from front to back.

The following folds are for completing the top shelf or first shelf. FIG. 10 shows the first shelf in an unfolded state and FIG. 9 shows all of the shelves in a folded state. Panel 1 has three horizontal fold lines and three sub-panels 50, 51, 52, and slot 53 centrally disposed on fold line 2.5'. To construct this part of the shelf, fold panel 50 90° along line 1.5' toward panel 6, and panel 52 90° along line 2.5' and insert panel 50 through slot 54 of panel 6 (See FIG. 13). Panel 53 is oriented horizontally, panel 51 is oriented vertically, and slot 53 faces upwardly. An inner surface of panel 50 is in face-to-face contact with a portion of an outer surface of panel 6 and a surface 55 of the slot 54 abuts a portion of a lower surface of panel 52 along line 1.5' and supports panel 52. In a preferred form of the invention, panel 50 points downwardly. Panel 9 has a tab 56 centrally disposed along a distal end edge and is folded along line 3.5' 90° upward toward panel 6 and inserted into tab 58 in panel 6 and extends outward from a rear surface of panel 6 (See FIGS. 9 and 13).

Panel 7 has two fold lines 6.5', 7.5' and three sub-panels 70, 72, 74. To construct this part of the shelf, fold panel 70 90° along line 6.5' and panel 72 along line 7.5' to form a U-shaped member with panels 70 and 74 being disposed vertically in parallel spaced relationship and panel 72 oriented horizontally. Panel 70 is placed into face-to-face contact with panel 51 of panel 1 (FIG. 9).

Panel 15 has two fold lines 8.5' and 9.5', three panels 80, 82, 84, and a tab 86. The tab 86 can be pressed and broken away from the panel 80 to pivot along a hinge 85. The tab 86 has a peripheral edge that can be weakened, for example by partially cutting through the panel so that three edges are frangibly connected to the panel 80 and one edge 85 forms a hinge. To construct this part of the shelf, fold panel 82 180° toward the back wall and downward along line 8.5' to place panel 82 into face-to-face contact with a rear surface of panel 84 (FIG. 9). Thus, panel 82 provides vertical support from above panel 15. Fold panel 80 90° upward and toward back wall 6 and over panels 52, 72, and deform tab 86 downward and insert it into slot 53. Slot 53 retains the tab 86 and, in a preferred form of the invention, releasably retains the tab so that it can be removed without destroying the tab 86. Panel 80 is in surface contact and is supported by panels 52, 72. Thus, as shown in FIG. 9, the first shelf has three horizontally extending supports panels 52,72,80 supported along the entire length of four horizontally extending and horizontally spaced fold lines 1.5',2.5',7.5',9.5' by vertically extending panels 6 through slot 55,4,20,82. Panels 6 through slot 55, 4 and 20 provide support from below panel 15 and panel 82 provides support from above panel 15.

Figure 13:
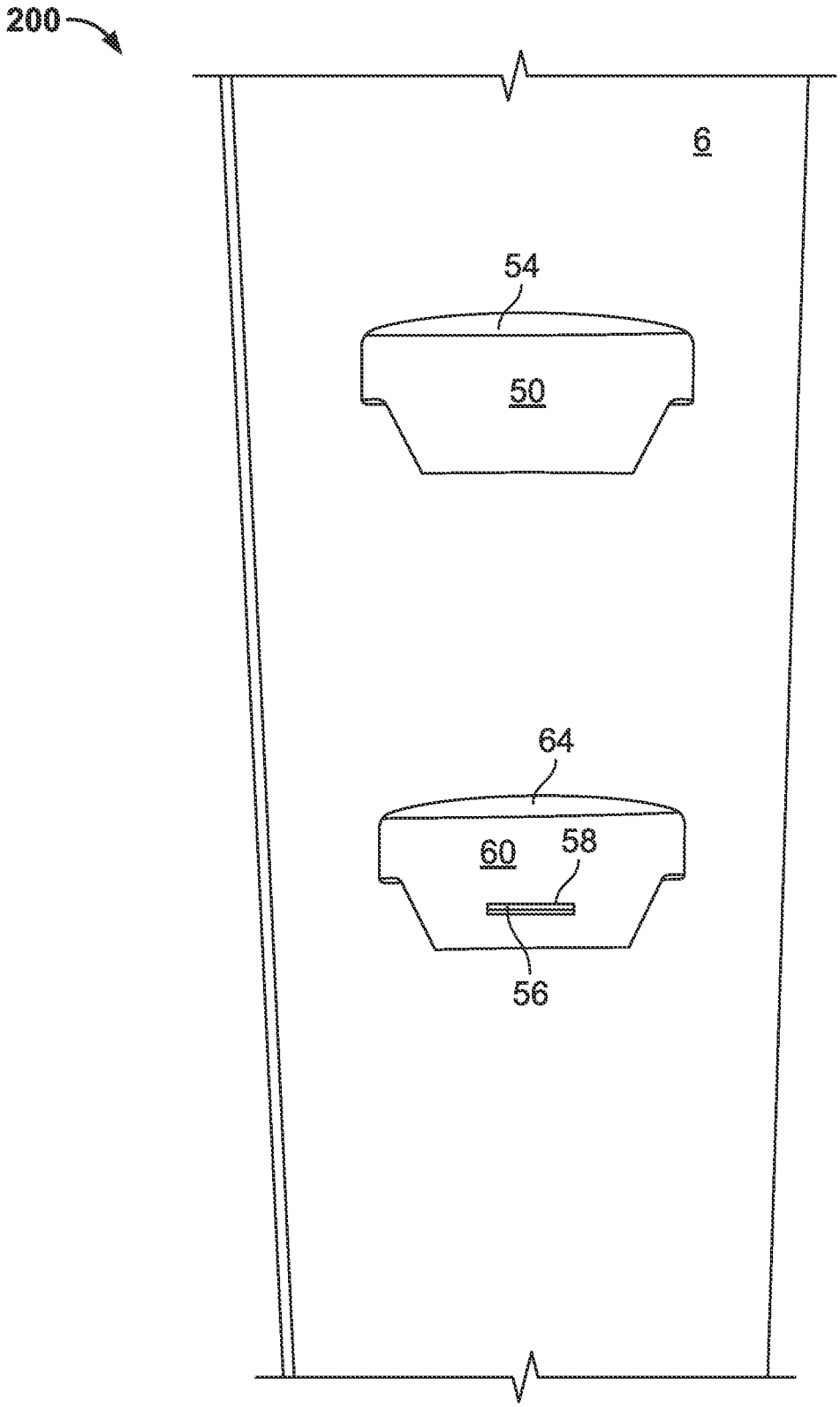
FIG. 13 is a front elevation view of a rear wall of the hutch.

The following describes the folding of the panels (FIG. 11) to complete the second shelf vertically spaced below the first shelf. FIG. 7 shows panel 2 has three panels 60, 61, 62, two horizontal fold lines 4.5' and 5.5' and two slots 63, 66. Fold panel 60 90° along line 4.5' toward the back panel 6; fold panel 62 90° along line 5.5' toward the back wall 6 and insert panel 60 into slot 64 of the back panel 6 and place slit 66 of panel 60 over tab 56 to form an interference fit therewith (FIGS. 9 and 13). An inner surface of panel 66 is in face-to-face contact with a portion of an outer surface of panel 6. A top surface 65 of the slot 64 abuts an underside surface of panel 62 along fold line 5.5' and supports panel 62 in a horizontal orientation. When so folded, panel 2 defines a generally U-shaped structure with two vertical panels 60 and 61 and one horizontal panel 62 connecting the vertical panels. The U-shaped structure 60,61,62 is positioned within a U-shaped structure formed by horizontally extending panel 9 on the bottom, horizontally extending panel 90 on the top and vertically extending panel 92 connecting panels 9,90 (FIG. 9).

Panel 8 has panels 90 and 92, separated by fold line 10.5', tab 94 centrally disposed on panel 90 and frangibly connected thereto, and slot 96 is centrally disposed along line 10.5'. Panel 90 is folded 90° downward toward the back wall and tab 94 is folded 90° downward to form an L-shaped member and inserted into slot 63 of panel 2. Slot 96 and a surface of panel 90 face upwardly and panel 92 has a planar surface oriented vertically.

Panel 14 has three panels 100, 102, 104, and a tab 106 frangibly connected and centrally disposed on panel 100. Panel 102 is folded 180° toward the back panel 6 along line 11.5' and positioned in face-to-face contact with an inner surface of panel 104. Panel 100 is folded 90° upward along fold line 12.5'. Tab 106 is pressed downward from panel 100 and remains connected along a hinge 108 and the remainder of the tab is inserted into slot 96. This completes a second shelf with a horizontal surface with panels 14, 8, 2 supported along a length dimension by supports 102 and 104 providing support from above the second shelf and panels 92, 61 and 60 from below panel 8 and 14.

The following describes the folding of the panels to complete the third shelf (FIG. 12) or bottom shelf vertically spaced below the second shelf. FIG. 7 shows panel 3 has five panels 130, 132, 134, 136, 138; cutout 140; and a slot 142. In a preliminary fold, panel 3 is folded along lines 13.5' to 15.5' to place panel 130 into contact with an inner surface of panel 136 to form a first rectangular prism with panel 134 forming a horizontally extending surface and panels 136 and 138 oriented with a vertically extending and coplanar surface. This preliminary fold is not shown in the figures. The rectangular prism is then rotated about fold line 16.5' 90° so that panel 132 forms a bottom wall extending horizontally, panel 136 forms a top wall extending horizontally, panel 134 extends vertically and abuts an inner surface of the back panel 6, panel 130 is positioned inside the rectangular prism extending roughly vertically and abuts against an inner surface of panel 138 which has a vertically extending planar surface as is shown in FIG. 9. Cutout 140 is provided for ease of folding.

As shown in FIG. 7, panel 10 has four panels 150, 152, 154, 156; and a cutout 158. Panel 10 is folded along lines 17.5' to 19.5' to form a second rectangular prism with panel 154 forming a horizontally extending planar surface and panels 152 and 156 having a vertically extending planar surface. Cutout 158 is provided for ease of folding.

As shown in FIG. 7, panel 13 has two panels 170, 172, and tab 174 frangibly connected to and centrally disposed on panel 170 and connected by a hinge 176. Panel 13 is folded 90° toward the back panel along line 20.5' and tab 174 is pushed downwardly and inserted into slot 142. This completes the bottom shelf. Thus, the bottom shelf has five horizontally extending supports 170, 132, 136, 150, 154 and seven vertical supports 130, 132, 134, 138, 152, 156, 172.

Four foot panels 180 are folded 90° along line 21.5' toward an interior of the hutch to form feet.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims. The appended claims should be construed broadly and in a manner consistent with the spirit and the scope of the invention herein.

We claim:

1. A hutch formed from a blank of material comprising:
- a back wall;
- a first side wall extending from a first edge of the back wall to a front of the hutch;
- a second side wall extending from a second edge of the back wall the front of the hutch;
- a first shelf extending from the front of the hutch to the back wall;
- a first supporting panel below a first portion of the first shelf; and,
- a second supporting panel below a second portion of the first shelf;
- a second shelf extending from the front of the hutch to the back wall, the second shelf spaced below the first shelf;
- a third supporting panel below a first portion of the second shelf; and
- a fourth supporting panel below a second portion of the second shelf;
- a third shelf extending from the front of the hutch to the back wall, the third shelf spaced below the second shelf;
- a fifth supporting panel below a first portion of the third shelf; and,
- a sixth supporting panel below a second portion of the third shelf;
- a first support panel extending between the first side wall and the second side wall, the first support panel including the first supporting panel, the third supporting panel and the fifth supporting panel;
- a second support panel extending between the first side wall and the second side wall spaced from the first support panel, the second support panel including the second supporting panel, the fourth supporting panel and the sixth supporting panel;
- a shelf panel extending between the first side wall and the second side wall, the shelf panel including the first shelf, the second shelf and the third shelf;
- a first front panel extending upward from the first shelf between the first side wall and the second side wall; and,
- a second front panel extending upward from the second shelf between the first side wall and the second side wall.

2. The hutch of claim 1 further comprising a third front panel extending upward from the third shelf between the first side wall and the second side wall.

3. The hutch of claim 2 wherein the hutch is formed from a single blank of material.

4. The hutch of claim 1 wherein the hutch is formed from paperboard.

5. A The hutch comprising:
- a back wall;
- a first side wall extending from a first edge of the back wall to a front of the hutch;
- a second side wall extending from a second edge of the back wall the front of the hutch;
- a first shelf extending from the front of the hutch to the back wall;
- a first supporting panel below a first portion of the first shelf;
- a second supporting panel below a second portion of the first shelf;
- a second shelf extending from the front of the hutch to the back wall, the second shelf spaced below the first shelf;
- a third supporting panel below a first portion of the second shelf; and a fourth supporting panel below a second portion of the second shelf;

a third shelf extending from the front of the hutch to the back wall, the third shelf spaced below the second shelf;

a fifth supporting panel below a first portion of the third shelf and, a sixth supporting panel below a second portion of the third shelf;

a first support panel extending between the first side wall and the second side wall, the first support panel including the first supporting panel, the third supporting panel and the fifth supporting panel;

a second support panel extending between the first side wall and the second side wall spaced from the first support panel, the second support panel including the second supporting panel, the fourth supporting panel and the sixth supporting panel;

a shelf panel extending between the first side wall and the second side wall, the shelf panel including the first shelf, the second shelf and the third shelf; and, a first slot in the back wall for receiving a tab from the first supporting panel.

6. The hutch of claim 5 further comprising:

a second slot in the back wall for receiving a tab from third supporting panel.

* * * * *